US011465153B2

(12) United States Patent
Deng et al.

(10) Patent No.: US 11,465,153 B2
(45) Date of Patent: Oct. 11, 2022

(54) ANTI-ADHESION CRUSHING TOOL FOR CRUSHING DAMP ORES

(71) Applicant: CHENGDU UNIVERSITY OF TECHNOLOGY, Chengdu (CN)

(72) Inventors: Xingqiao Deng, Chengdu (CN); Zhifei Du, Chengdu (CN); Lun Wang, Chengdu (CN); Chengfu Li, Chengdu (CN)

(73) Assignee: Chengdu University of Technology, Chengdu (CN)

( * ) Notice: Subject to any disclaimer, the term of this patent is extended or adjusted under 35 U.S.C. 154(b) by 0 days.

(21) Appl. No.: 17/130,788

(22) Filed: Dec. 22, 2020

(65) Prior Publication Data

US 2021/0220834 A1 Jul. 22, 2021

(30) Foreign Application Priority Data

Jan. 16, 2020 (CN) ..... 202010057569.7

(51) Int. Cl.
*B02C 4/30* (2006.01)

(52) U.S. Cl.
CPC ..... *B02C 4/30* (2013.01)

(58) Field of Classification Search
CPC ..... B02C 4/08; B02C 4/30
USPC ..... 492/30, 33, 34; 241/236
See application file for complete search history.

(56) References Cited

U.S. PATENT DOCUMENTS

| | | | | | |
|---|---|---|---|---|---|
| 27,160 | A * | 2/1860 | Sault | C08J 3/16 | 528/502 F |
| 1,356,291 | A * | 10/1920 | Josephe | B02C 4/08 | 241/293 |
| 2,338,635 | A * | 1/1944 | Galber | B27G 11/00 | 118/72 |
| 2,596,997 | A * | 5/1952 | Harter | E06B 9/266 | 29/6.1 |
| 3,425,640 | A * | 2/1969 | Macholdt | B65G 53/48 | 222/413 |
| 3,633,831 | A * | 1/1972 | Dodson | D21B 1/10 | 241/73 |
| 3,862,721 | A * | 1/1975 | Flair | B02C 18/142 | 241/293 |
| 4,252,282 | A * | 2/1981 | Vermeulen | A22C 17/06 | 83/835 |
| 2021/0178401 | A1* | 6/2021 | Zebroski | B02C 4/30 | 241/293 |

* cited by examiner

*Primary Examiner* — Debra M Sullivan
*Assistant Examiner* — Matthew Stephens
(74) *Attorney, Agent, or Firm* — Michael X. Ye; Rimon, PC

(57) ABSTRACT

The present invention relates to an anti-adhesion crushing tool for crushing damp ores. The anti-adhesion crushing tool can effectively improve the current working environment in attapulgite crushing, and is beneficial to effectively improve the anti-adhesion properties of the attapulgite clay.

13 Claims, 3 Drawing Sheets

ANTI-ADHESION CRUSHING TOOL FOR CRUSHING DAMP ORES

CROSS-REFERENCE TO RELATED APPLICATIONS

This application claims the benefit of the Chinese Patent Application No. CN202010057569.7 filed on Jan. 16, 2020, which is hereby incorporated by reference as if fully set forth herein.

BACKGROUND OF THE INVENTION

1. Technical Field

The present invention relates to mining tools, and more particularly to an anti-adhesion crushing tool for crushing damp ores.

2. Description of Related Art

As a rare non-metal mineral resource, attapulgite clay is extensively used in various areas such as agricultural and livestock production, the building materials industry, the petroleum industry, metallurgy and food production. Attapulgite clay is structurally a layer-chain hydrous rich magnesium aluminum silicate soil mineral. Currently, 70% of the proven reserves of attapulgite clay around the world is in China. Attapulgite clay has to be crushed into a pellet size of, for example, 5 mm~20 mm before it can be deeply processed. However, different from other crushed materials, attapulgite clay is rich of water (with a water content as high as 20%~45%). Due to its high water content, attapulgite clay has a cohesive force up to 70 Kpa and an angle of internal friction up to 40°, thereby exhibiting strong cohesiveness.

Therefore, how to crush highly cohesive attapulgite clay effectively has become a technical issue to be addressed in the art. Conventionally, attapulgite clay is crushed in the following ways:

1. Drying before crushing refer to a discontinuous production process. The "drying" may be realized by means of sun-drying or coal-furnace-drying. Sun-drying uses solar energy to vaporize moisture from attapulgite clay, but it has limited use due to requirements in terms of weather, site, labor and environmental protection. Drying in coal furnaces, on the other hand, has shortcomings such as small processing batches, discontinuous processing and harm to the environment.

2. Directly crushing means crushing hydrous, cohesive attapulgite clay without dehydrating it in advance, and is a continuous production process. Crushing happens when an external force is applied to a solid material and reform the solid material into small pellets by means of cutting, punching, rolling, grinding and crashing. For example, a jaw crusher may be useful to crush attapulgite clay. However, a jaw crusher works by applying a pressure and using the brittleness of the material to be crushed itself to disintegrate the material into pieces. When working with attapulgite clay, a jaw crusher can only cut the damp ores into cakes, and fails to meet the expectoration for large-batch production. In addition, attapulgite clay with high cohesiveness tends to adhere to the crushing tool, and this can prevent the crushing tool from doing its crushing work as scheduled, even getting the crushing tool stuck and eventually leading to breakdown.

For example, China Patent Publication No. CN107570292B discloses a double-deck crusher for attapulgite clay, which includes a feed hopper, a coarse powder device, a connecting plate, a support device and a milling device. The feed hopper is arranged at the top of coarse powder device, and the milling device is arranged at the bottom of the coarse powder device. The coarse powder device is mounted in the support device via the connecting plate. The support device has a rectangular configuration. The coarse powder device and the milling device are arranged in a staggered and layered manner for crushing attapulgite clay entering the feed hopper in a layered way. The coarse powder device at the upper layer does primary crushing to attapulgite clay, and the milling deice at the lower layer further fines the coarse powder, so as to ensure effective crushing. The prior-art machine has four novel milling tools at the second layer. Since the four faces may be engaged with each other, and fine teeth distributed over the surfaces can tear attapulgite clay pats as products of the crushing work at the upper layer, the final processed attapulgite pellets have a size that satisfies requirements for subsequent processing.

For example, China Patent Publication No. CN104785340B discloses an attapulgite coarse crushing cutter, which comprises a cutter head and 3-6 sets of combined tool bits, wherein the cutter head is in a circular table form. A mounting hole combined with a roll shaft is formed in the center part of the cutter head. Dovetail block bodies which are matched with the combined tool bits in quantity are arranged on the cylindrical surface of the cutter head. The dovetail block bodies are evenly distributed around the cylindrical surface of the cutter head. Each combined tool bit comprises a primary tool bit and a secondary tool bit. Each primary tool bit comprises an attapulgite crushing head and a connecting body. Each secondary tool bit is a plate-shaped body. A bump which is matched with a limiting groove in the attapulgite crushing head is arranged on the top surface of each secondary tool bit. The bottom surface is an arc surface matched with the cylindrical surface of the cutter head. The front surface is a working surface. A cycloidal tooth and a cycloidal groove are formed in the working surface. Each secondary tool bit is fixedly arranged on the bearing surface of the connecting body in each primary tool bit, and is located below each attapulgite crushing head. Each secondary tool bit is detachably connected with each primary tool bit. Various combined tool bits are respectively arranged at the positions, with the dovetail block bodies, on the cylindrical surface of the cutter head, are fixed through baffle plates and bolts, and are detachably connected with the cylindrical surface.

For example, China Patent Publication No. CN203899718U discloses a grinding device for preventing attapulgite from being cured in process of generating clay. The grinding device comprises a charging device, a grinder, a powder grinding screw device, a rotary screen device and a storage barrel, wherein the grinder is used for grinding thick attapulgite blocks; the powder grinding screw device is used for grinding the ground attapulgite into powder; a screw is arranged inside the powder grinding screw rod device, and a cooling fan used for reducing temperature of the screw is arranged outside the powder grinding screw rod device; an output end of the rotary screen device is connected with the storage barrel; and the rotary screen device is used for conveying the attapulgite ground into powder to the storage barrel. According to the grinding device, the cooling fan is arranged outside the powder grinding screw device, the temperature of the screw in the operating process is reduced, the inner screw is provided with an acceleration section, a constant speed section and a speed reduction section, so that temperature rise of the attapulgite powder is well controlled. According to the device, the attapulgite can be effectively prevented from being cured in the grinding and clay generating process, and the quality of generated clay is improved.

China Patent Publication No. CN109261271A discloses a crushing plant for attapulgite, including a rolling case and crushing case. The rolling case has its upper middle part provided with a feed guiding-in. The feed guiding-in is internally provided with roller. The roller has its left part provided with a second gear wheel. The rolling case has its right part provided with a pipeline. The pipeline has its upper end communicated with the rolling case. The rolling case has its lower end provided with a crushing case. An inclined filtering plate partially filters the passing attapulgite clay so that the material meeting filtering criteria falls down to the bottom of the crushing case. Pellets with larger sizes are guided to the crushing case through the pipeline by the filtering plate. Since the crushing roller is also electromechanically controlled, it rotates synchronously. As the crushing roller only works on the material that has been processed by the roller at the upper layer, the crushing operation is more specific.

China Patent Publication No. CN202823468U discloses a jaw crusher for attapulgite clay. The jaw crusher comprises a rack, a fixed jaw plate, a moving jaw plate, a moving jaw, an eccentric shaft, a toggle plate and a regulating seat, wherein the plate surfaces of the fixed jaw plate and the moving jaw plate are both provided with a plurality of projections. It works as follows. When raw large-sized attapulgite ores enter the jaw crusher, they are first retained by the projections of the fixed and moving jaw plates. In the process that the moving jaw plat comes close to the fixed jaw plate, attapulgite ores are compressed repeatedly. The compressed attapulgite ores then hot on the projections of the fixed and moving jaw plates to be further crushed. After the processed, small-sized attapulgite ores are introduced into the jaw crusher, they repeatedly hit on the projections of the fixed and moving jaw plates, so as to be further crushed by the impact force.

Attapulgite clay is one of the materials for making nanometer ceramic separators of lithium-ion batteries, and its physical properties determine the key performance of the resulting separators. If attapulgite clay has moisture therein vaporized and then undergoes the crushing operation, its cohesion is degraded due to the reduced moisture. This can directly reduce the physical performance of the processed attapulgite ores, and indirectly make nanometer material separators in lithium-ion batteries deteriorate in terms of performance. Besides, in view of the increasingly demanding requirements for environmental protection and for energy conservation, the traditional "drying and then crushing" process for attapulgite clay is no more competent. In addition, drying attapulgite clay before crushing it requires a discontinuous process, and this can have adverse effects on the crushing efficiency for making attapulgite pellets.

Since there is certainly discrepancy between the prior art comprehended by the applicant of this patent application and that known by the patent examiners and since there are many details and disclosures disclosed in literatures and patent documents that have been referred by the applicant during creation of the present invention not exhaustively recited here, it is to be noted that the present invention shall actually include technical features of all of these prior-art works, and the applicant reserves the right to supplement the application with the related art more existing technical features as support according to relevant regulations.

SUMMARY OF THE INVENTION

As a solution to the foregoing problems, an anti-adhesion crushing tool for crushing damp ores, and more particularly to a bionics-based crushing tool for attapulgite, comprising a guiding-in slope for crushing damp ores into damp ore pellets, and the guiding-in slope forms a non-steep connecting portion between the top portion and the valley portion of the crushing tooth, so that non-steep crushing gaps are formed between the top portions of the corresponding crushing teeth and the curved bottom of the matched crushing cavities. In a rotation direction of the crushing roller, the top portion of the crushing tooth that follows the guiding-in slope and has a roughly plateau-like shape transitionally extending to a guiding-out slope in a non-steep manner, and the guiding-out slope transitionally extending to a root portion of the guiding-in slope of the adjacent crushing tooth along the rotation direction of the crushing roller in a non-steep manner, whereby a transitionally connecting portion that has at least two curvatures is formed between each two adjacent said crushing teeth. The transitionally connecting portion extends in a non-steep manner all along the rotation direction for crushing operation.

According to one preferred embodiment, the crushing tooth has an annular crushing pattern that is formed by having the top portion transitionally connected to the valley portions at two sides thereof through the guiding-out slope and the guiding-in slope, respectively, so that the transitionally connecting portions are spaced along the circumferential direction of the crushing roller, thereby, during rotation of the crushing roller, the crushing patterns are able to rotate with respect to the matched crushing cavities in a manner that the crushing gaps rise and fall.

According to one preferred embodiment, a rate by which a guiding-in slope angle of the guiding-in slope changes with a guiding-in radial height of the guiding-in slope is smaller than a rate by which a guiding-out slope angle of the guiding-out slope changes with a guiding-out radial height of the guiding-out slope, so that in the rotation direction of the crushing roller, the curvature of the transitionally connecting portion at a front side of the top portion is greater than the curvature of the transitionally connecting portion at a back side of the top portion.

According to one preferred embodiment, two adjacent said top portions in an axial direction of the crushing roller are separated by the valley portion, so that the transitionally connecting portions of two adjacent said crushing patterns are circumferentially staggered to each other, whereby, during rotation of the crushing roller, two adjacent said crushing gaps in the axial direction are able to crush the cohesive damp ores into cohesive damp pellets in a manner that the crushing gaps rise and fall asynchronously.

According to one preferred embodiment, a radial height between the top portion and the valley portion is greater than a first radial width between the top portion and the corresponding crushing cavity, so that during rotation of the crushing roller, a second radial width of the crushing gap periodically changes based on the transitionally connecting portion in a range between one time of the first radial width and more than two times of the first radial width.

According to one preferred embodiment, the guiding-out slope, the top portion, the guiding-in slope and the valley portion are successively, smoothly connected to form the non-flat, wavy annular crushing pattern, in which, the top portion has a radian smaller than a radian of the valley portion.

According to one preferred embodiment, the crushing cavities are smooth cavities formed by annular crushing patterns that are parallel to and spaced from each other and a circumferential surface of a roller body of the crushing roller, so that when the annular crushing patterns engage with the corresponding crushing cavities, the cohesive ore pellets can come off the crushing cavities as the slope angle of the guiding-out slope gradually decreases in a manner that an adhesion force between the cohesive ore pellets and the crushing cavities is smaller than a centrifugal force applied thereto by the crushing roller.

According to one preferred embodiment, in the rotation direction of the crushing roller, a front end of the valley portion that has a roughly flat or wavy surface extends to the top portion of the crushing tooth in a manner that the guiding-out slope angle of the guiding-out slope increases gradually, and a rear end of the valley portion extends to the top portion of a next said crushing tooth through the guiding-in slope of the next crushing tooth in a manner that the guiding-in slope angle increases gradually, so that the transitionally connecting portion that has at least two curvatures is formed between each two adjacent said crushing teeth.

According to one preferred embodiment, the present invention further discloses an anti-adhesion crushing method for crushing attapulgite clay, comprising using the crushing tool of any of the preceding claims, wherein the crushing roller rotates in a continuous or stepped manner.

According to one preferred embodiment, the present invention further discloses a crushing roller, having wavy, annular crushing patterns spaced in an axial direction thereof wherein a crushing cavity is formed between each two adjacent said annular crushing patterns; each said annular crushing pattern comprising a guiding-out slope, a top portion, a guiding-in slope and a valley portion, in which the guiding-out slope, the top portion, the guiding-in slope and the valley portion are successively, smoothly connected to form the non-flat, wavy annular crushing pattern; and when the crushing roller and a further said crushing roller rotate toward each other or either of which rotates with respect to the other, the crushing gaps being formed as the annular crushing patterns lodge in the crushing cavities of the further crushing roller and the wavy, annular crushing patterns of the further crushing roller lodge in the crushing cavities of the crushing roller, so that cohesive damp ores entering the crushing gaps that dynamically rise and fall are crushed without adhering to the rollers.

The present invention provides a bionics-based anti-adhesion crushing tool for crushing damp ores and has at least the following advantages. The crushing tool has an annular crushing pattern whose design is inspired by wriggling movements of earthworms in soil and plate-like scales of pangolins. However, the structures of the two creatures can only prevent adhesion, and are not helpful to crushing highly cohesive minerals. In the present embodiment, cohesive attapulgite ores falling on first and second crushing rollers of the crushing tool from above by the gravity come into contact with the surfaces of the two rollers, and then gradually enter crushing gaps as the first and second crushing rollers rotate toward each other so as to be ground, crushed and/or torn into attapulgite pellets in the crushing gaps. At last, the attapulgite pellets in the rising and falling crushing gaps can come off the crushing tool under the effect of the rising and falling of the crushing gaps and the centrifugal force caused by the crushing tool. The rising and falling of the crushing gaps serves to make the contact pressure between the attapulgite pellets and the tool have non-linear, dynamic change. This in turn makes the adhesion force between the attapulgite pellets and the tool have non-linear, dynamic change, so that when the centrifugal force becomes greater than the adhesion forces, the attapulgite pellets come off the tool. Moreover, as cohesive attapulgite clay contains large quantity of water, a water film forms between the attapulgite pellets and the tool, and the rising and falling of the crushing gaps has effects on the depth of this water film. Particularly, the deeper the water film is, it can be broken away more easily. The rising and falling of the crushing gaps can increase the depth of the water film in a non-linear manner until the attapulgite pellets break away from the water film.

Figure 1:
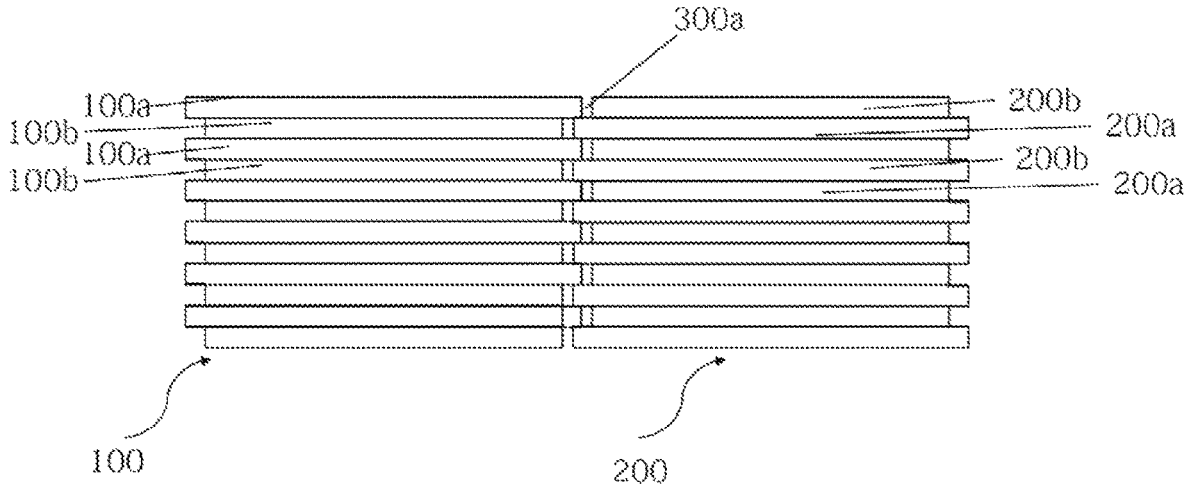
FIG. 1 schematically illustrates a bionics-based anti-adhesion crushing tool for crushing damp ores as provided in the present invention.

100: first crushing roller; 200: second crushing roller; 100*a*: first annular crushing patterns; 100*b*: crushing cavities; 100*c*: top portion; 100*d*: valley portion; 100*e*: guiding-out slope; 100*f*: guiding-in slope; 200*a*: second annular crushing patterns; 200*b*: second crushing cavity; θ: guiding-in slope angle; β: guiding-out slope angle; 300*a*: crushing gaps.

DETAILED DESCRIPTION OF THE INVENTION

The following detailed description will be made with reference to FIGS. 1-4.

The present invention relates to an anti-adhesion crushing tool used for crushing damp ores, and particularly attapulgite clay, which is configured to crush cohesive attapulgite clay into cohesive attapulgite pellets. Attapulgite clay is one of the materials for making nanometer ceramic separators of lithium-ion batteries, and its physical properties determine the key performance of the resulting separators. If attapulgite clay has moisture therein vaporized and then undergoes the crushing operation, its cohesion is degraded due to the reduced moisture. This can directly reduce the physical performance of the processed attapulgite ores, and indirectly make nanometer material separators in lithium-ion batteries deteriorate in terms of performance. Besides, in view of the increasingly demanding requirements for environmental protection and for energy conservation, the traditional "drying and then crushing" process for attapulgite clay is no more competent. In addition, drying attapulgite clay before crushing it requires a discontinuous process, and this can have adverse effects on the crushing efficiency for making attapulgite pellets.

However, hydrous attapulgite ores are highly cohesive, and the existing crushing devices can either fail to well crush the material or have problems about being stuck due to the cohesiveness of the material. For example, the inventor found in experiments that a jaw crusher can directly compress attapulgite clay in to cakes. Also as demonstrated in experiments conducted by the inventor, some existing crushing rollers can break large-sized attapulgite ores into relatively small pieces but fail to meet the size requirement of 5~20 mm. Other existing crushing rollers may have the ability to produce pellets of 5~20 mm, but their crushing gaps tend to be stuck by attapulgite clay. Therefore, the existing devices are not competent means for crushing cohesive attapulgite clay at all.

Bionics is an advanced technology that applies structural and functional principles of organisms to inventions of novel equipment, tools and techniques for improving production and promoting scientific development. The inventor of the present invention spent years in researching into how earthworms, dung beetles and pangolins move in soil and has found that earthworms, dung beetles and pangolins have their non-smooth body surfaces effective in preventing adhesion. After modeling, simulation and extensive experiments, the inventor devised special crushing teeth for a crushing tool that bionically mimic the body structure of earthworms and are effective in preventing attapulgite pellets from blocking crushing gaps.

Embodiment 1

Figure 3:
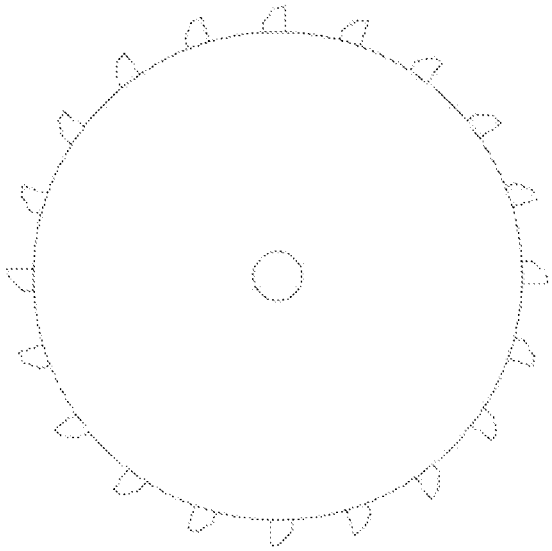
FIG. 3 is a conventional crushing tool in the art of the present invention.

FIG. 3 shows a conventional crushing roller, which comprises crushing teeth spaced along its circumference. Each two adjacent teeth are not in contact with each other, and the tooth has a steep shape. In use, the cohesive material being processed can build up at the root portions of the crushing teeth, and eventually block the crushing gaps after long-term use. Bionics is an advanced technology that applies structural and functional principles of organisms to inventions of novel equipment, tools and techniques for improving production and promoting scientific development. After modeling, simulation and extensive experiments, the inventor devised special crushing teeth for a crushing tool that bionically mimics the body structure of earthworms and is effective in preventing attapulgite pellets from blocking crushing gaps.

Figure 2:
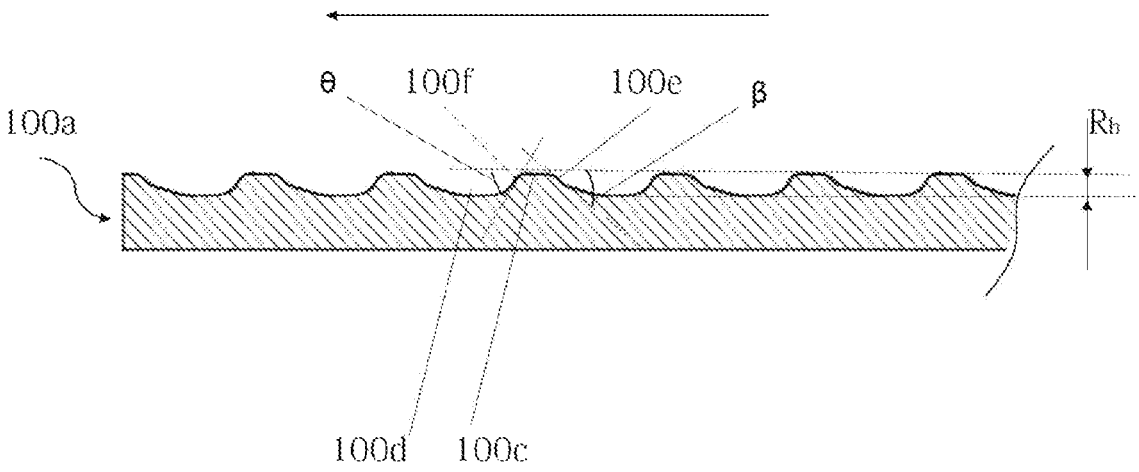
FIG. 2 depicts a preferred bionic crushing pattern according to the present invention.

Based on this, the present embodiment discloses an anti-adhesion crushing tool for crushing damp ores. The crushing tool comprises crushing rollers. The crushing roller comprises a roller body and crushing teeth axial spaced on the roller body for crushing damp ores into damp ore pellets. As shown in FIG. 2, the crushing tooth comprises a guiding-in slope 100*f*, a top portion 100*c*, a valley portion 100*d* and a guiding-out slope 100*e*. The guiding-in slope 100*f* forms a non-steep connecting portion between the top portion 100*c* and the valley portion 100*d* of the crushing tooth. The term "non-steep" when used to describe the profile of the guiding-in slope 100*f* means that mathematically the profile changes continuously without any discontinuities. The guiding-in slope 100*f* serves to firstly shovel clay to simulate wriggling movements of earthworms in soil. In the rotation direction ω of the crushing roller, the top portion 100*c* of the crushing tooth that follows the guiding-in slope 100*f* and has a roughly plateau-like shape transitionally extending to the guiding-out slope 100*e* in a non-steep manner. Preferably, the guiding-out slope 100*e* transitionally extends to the root portion of the guiding-in slope 100*f* of the next crushing tooth along the rotation direction ω of the crushing roller. During its extension, the guiding-out slope has its angle β change in a non-steep manner so that a transitionally connecting portion that has at least two curvatures is formed between two adjacent crushing teeth. The transitionally connecting portion extends in a non-steep manner all along the rotation direction ω for crushing operation. As shown in FIG. 2, non-steep crushing gaps 300 are formed between the top portions 100*c* of the corresponding crushing teeth and the curved bottom of the matched crushing cavities. As shown in FIG. 2, the first crushing roller 100 has wavy first annular crushing patterns 100*a* spaced in its axial direction. Each of the first annular crushing pattern 100*a* is composed of the guiding-out slope 100*f*, the top portion 100*c*, the guiding-out slope 100*e* and the valley portion 100*d* arranged successively. A first crushing cavity is 100*b* formed between two adjacent first annular crushing patterns 100*a*. The second crushing roller 200 has wavy second annular crushing patterns 200*a* spaced in its axial direction. A second crushing cavities 200*b* is formed between two adjacent second annular crushing patterns 200*a*. The first annular crushing pattern 100*a* lodges in the corresponding second crushing cavity 200*b*, and the radial intervals therebetween are the crushing gaps 300. Meanwhile, the second annular crushing pattern 200*a* lodges in the corresponding first crushing cavity 100*b*, and the radial intervals therebetween are further crushing gaps 300. When the first crushing roller 100 and the second crushing roller 200 rotate toward each other, the crushing gaps 300 dynamically rise and fall with the changing wavy profiles of the first annular crushing patterns 100*a* and/or the second annular crushing patterns 200*a*. The annular crushing pattern is inspired by wriggling morphology of earthworms in soil. In the present embodiment, cohesive attapulgite ores falling on first and second crushing rollers 100, 200 from above by the gravity first come into contact with the surfaces of the two rollers, and then gradually enter crushing gaps as the first and second crushing rollers 100, 200 rotate toward each other so as to be ground, crushed and/or torn into attapulgite pellets in the crushing gaps 300. At last, the attapulgite pellets in the rising and falling crushing gaps 300 can come off the crushing tool under the effect of the rising and falling of the crushing gaps 300 and the centrifugal force caused by the crushing tool.

Figure 4:
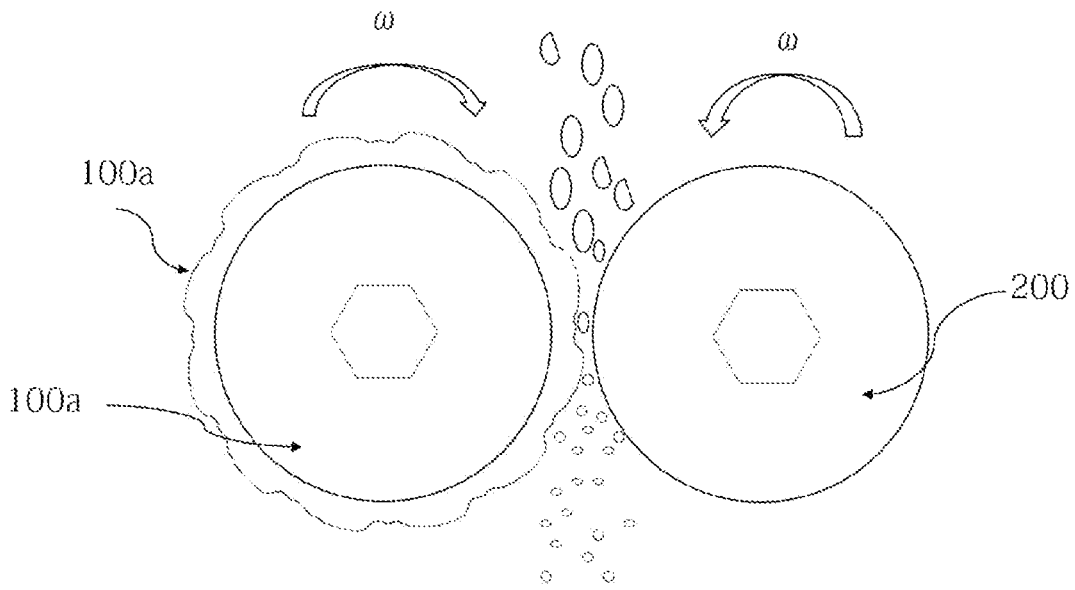
FIG. 4 is a schematic drawing of the crushing tool of the present invention.

Preferably, the crushing teeth form the annular crushing patterns by having the top portion 100*c* transitionally connected to the valley portions 100*d* at its two sides through the guiding-out slope 100*e* and the guiding-in slope 100*f*, respectively. Therefore, during rotation of the crushing rollers, the double-curvature transitionally connecting portions, the top portions and the valley portions change the rising and falling patterns of the crushing gaps 300*a* according to predetermined periodicity, simulating earthworms wriggling in soil without having soil adhered thereto). The clay in the crushing gaps primarily undergoes operations of shoveling, pressing, grinding, and releasing. As shown in FIG. 4, plural attapulgite clay material masses are feed into the crushing tool from above and fall down between two crushing rollers by gravity. The rising and falling of the crushing gaps 300 serve to make the contact pressure between the attapulgite pellets and the tool have non-linear, dynamic change. This in turn makes the adhesion force between the attapulgite pellets and the tool have non-linear, dynamic change, so that when the centrifugal force becomes greater than the adhesion forces, the attapulgite pellets come off the tool. Moreover, as cohesive attapulgite clay contains a large quantity of water, a water film forms between the attapulgite pellets and the tool, and the rising and falling of the crushing gaps has effects on the depth of this water film. Particularly, the deeper the water film is, it can be broken away more easily. The rising and falling of the crushing gaps can increase the depth of the water film in a non-linear manner until the attapulgite pellets break away from the water film. The crushing tool is designed to crush raw attapulgite clay with a size of 15 mm~50 mm. The raw attapulgite clay is physically processed in the crushing gaps 300 through compressing and tearing to eventually be broken into small pellets. After repeated experiments, the final attapulgite pellets made from raw, cohesive attapulgite clay in one embodiment of the present invention had the pellets size of 5~20 mm.

Preferably, the top portion 100*c* has grains. The grains on the top portion 100*c* run roughly parallel to the direction of linear velocity. The grains are mainly inspired by the structure of the shell of a dung beetle. The shell of a dung beetle has spaced grains roughly parallel to its traveling direction. Preferably, the adjacent grains are connected in a smooth and continuous manner. Preferably, the interval between adjacent grains is narrower than the required pellet size, so that attapulgite pellets are unlikely to be inlaid between adjacent grains. Preferably, the grains have a wave height and a wave crest each of 1~3 mm. Preferably, an acute angle is included by the grains at the edge of the top portion and the direction of linear velocity. The acute angle is rough of 5~20°, so that attapulgite pellets are driven to move radiatively with respect to the top portions 100*c*. The inventor also found in a numerical simulation that transverse grains can mainly reduce adhesion between attapulgite pellets and the top portion 100*c*, so that the centrifugal force acting on the attapulgite pellets when the crushing rollers rotate is greater than the adhesion force, thereby allowing the attapulgite pellets to come off the tool. In addition, since attapulgite pellets contain water, a water film is formed between the attapulgite pellets and the tool. The transverse grains can change the depth of the water film. The deeper the water film is, the attapulgite pellets can escape from it more easily. The transverse grains can change the depth of the water film between the attapulgite pellets and the tool in a non-linear manner until the water film is broken away.

Preferably, a rate by which the guiding-in slope angle θ of the guiding-in slope 100*e* changes with a guiding-in radial height of the guiding-in slope 100*e* is smaller than a rate by which a guiding-out slope angle β of the guiding-out slope (100*f*) changes with a guiding-out radial height of the guiding-out slope 100*f*, so that in the rotation direction of the crushing roller, the curvature of the transitionally connecting portion at a front side of the top portion 100*c* is greater than the curvature of the transitionally connecting portion at a back side of the top portion 100*c*. Based on this, the contact pressure between the cohesive attapulgite pellets and the crushing tool can dynamically change with the profile of the crushing gaps 300 in a manner that it increases first and then stays steady before finally decreases, thereby allowing the cohesive attapulgite pellets to come off the valley portion 100*d* as the adhesion force between the attapulgite pellets and the crushing tool sharply decreases in the process that the first crushing roller 100 and the second crushing roller 200 rotate toward each other.

Preferably, the axially adjacent two top portions 100*c* of the crushing roller are separated by the valley portion 100*d*. As observed in the axial direction, the transitionally connecting portions of two adjacent said crushing patterns are circumferentially staggered to each other. Therefore, as the crushing rollers rotate toward each other, axially adjacent two crushing gaps 300 rise and fall asynchronously.

Preferably, a radial height $R_h$ between the top portion 100*c* and the valley portion 100*d* is greater than a first radial width between the top portion 100*c* and the corresponding crushing cavity, so that during rotation of the crushing rollers, a second radial width of the crushing gap 300 periodically changes based on the transitionally connecting portion in a range between one time of the first radial width and more than two times of the first radial width.

Preferably, the crushing cavities are smooth cavities formed by annular crushing patterns that are parallel to and spaced from each other and the circumferential surface of a roller body of the crushing roller. The smooth cavities can decrease the contact force between itself and the clay, thereby decreasing adhesion. Therefore, when the annular crushing patterns and the corresponding crushing cavities combine and form the crushing gaps 300, the cohesive attapulgite pellets can come off the crushing cavities 100*b* as the slope angle of the guiding-out slope 100*f* gradually decreases to the extent that the adhesion between the attapulgite pellets and the crushing cavities becomes smaller than the centrifugal force applied to the attapulgite pellets by the crushing rollers, thereby further preventing clogging.

Preferably, the valley portion 100*d* may be roughly horizontal or have a wavy surface with local bulges. The front end of the valley portion 100*d* extends to the top portion 100*c* of the present crushing tooth through the guiding-out slope 100*f* in a manner that the guiding-out slope angle θ gradually increases. The rear end of the valley portion 100*d* extends to the top portion of the next crushing tooth through another guiding-in slope in a manner that the guiding-in slope angle θ gradually increases. Therefore, the transitionally connecting portion having at least two curvatures is formed between two adjacent crushing teeth.

Embodiment 2

The present embodiment discloses an anti-adhesion crushing method for attapulgite clay as further improvements to Embodiment 1. Without causing conflict or contradiction, the entire and/or part of preferred modes of other embodiments may be incorporated into the present embodiment as supplements.

The present embodiment discloses a crushing tool configured to directly crush the cohered attapulgite clay into cohesive attapulgite ores.

As shown in FIG. 1, the crushing tool comprises a first crushing roller 100 and a second crushing roller 200. The first crushing roller 100 and the second crushing roller 200 are such arranged that their axes are parallel to each other. In addition, each of the rollers has a rotation shaft and a rotation drive mechanism. The respective rotation mechanism drives the rotation shafts to make the first crushing roller 100 and the second crushing roller 200 rotate toward each other or rotate away from each other. The first crushing roller 100 comprises a roller body. The roller body is structurally a revolving member, such as a column. The column is centrally formed with an axial hole for receiving the rotation shaft. The second crushing roller 200 has a roller body similar to that of the first crushing roller 100.

The first crushing roller 100 and the second crushing roller 200 when rotating toward or away from each other, can form crushing gaps 300. The crushing gaps 300 serve to crush cohesive attapulgite ores into cohesive attapulgite pellets. The crushed cohesive attapulgite pellets have a pellet size of 5~20 mm. Therefore, the crushing gaps 300 are sized in the range of 5~20 mm.

Preferably, as shown in FIG. 2, the first annular crushing pattern 100*a* comprises top portions 100*c* that are spaced in the circumferential direction of the first crushing roller 100. The adjacent two top portions 100*c* are connected by a valley portion 100*d*. When the first crushing roller 100 rotates with respect to the second crushing roller 200, the top portions 100*c* and the valley portions 100*d* alternately work with the second crushing cavities 200*b* to change the rising and falling profile of the crushing gaps 300.

Preferably, the top portion 100*c* is transitionally connected to valley portions 100*d* at its two sides through the guiding-out slope 100*e* and guiding-in slope 100*f*, respectively. Therein, the guiding-in slope angle θ of the guiding-in slope 100*e* is greater than the guiding-out slope angle β of the guiding-out slope 100*f*.

Preferably, a valley portion 100*d* is formed between axially adjacent two top portions 100*c* of the first crushing roller 100. Thereby, when the first crushing roller 100 and the second crushing roller 200 rotate toward each other, the adjacent two crushing gaps 300 can rise and fall asynchronously and crush cohesive attapulgite ores into cohesive attapulgite pellets.

Preferably, the guiding-out slope 100*e*, the top portion 100*c*, the guiding-in slope 100*f* and the valley portion 100*d* are connected as a unit having a continuous, smooth surface to form the non-flat, wavy first annular crushing pattern 100*a*. The radian of the top portion 100*c* is smaller than the radian of the valley portion 100*d*.

Preferably, the radial height $R_h$ between the top portion 100*c* and the valley portion 100*d* is greater than the minimum radial width between the top portion 100*c* and the second crushing cavity 200*b*, so that the cohesive attapulgite pellets meeting the granularity requirement can come off the valley portion 100*d* under the action of the centrifugal force as the crushing gaps 300 widen when the first crushing roller 100 and the second crushing roller 200 rotate toward each other.

Preferably, the crushing cavities 100*b* are smooth cavities formed by first annular crushing patterns 100*a* that are parallel to and spaced from each other and the circumferential surface of a roller body of the crushing roller, so that when the second annular crushing patterns 100*b* engage with the corresponding crushing cavities, cohesive attapulgite pellets can come off the crushing cavities 100*b* in a manner that an adhesion force between the cohesive attapulgite pellets and the crushing cavities 100*b* is smaller than a centrifugal force applied thereto by the crushing roller.

Embodiment 3

The present embodiment discloses an anti-adhesion crushing method for attapulgite clay as further improvements to Embodiment 1 or 2. Without causing conflict or contradiction, the entire and/or part of preferred modes of other embodiments may be incorporated into the present embodiment as supplements.

The method can crush cohesive attapulgite ores into cohesive attapulgite pellets while preventing cohesive attapulgite pellets from adhering to the crushing tool.

The crushing method comprises: providing a first crushing roller 100 and a second crushing roller 200 that are configured to rotate toward each other, wherein crushing gaps 300 serving to crush cohesive attapulgite ores crushing into cohesive attapulgite pellets are formed when at least one of the rollers rotates; providing wavy first annular crushing patterns 100*a* spaced along the axial direction of the first crushing roller 100 so that first crushing cavities 100*b* are formed between the adjacent first annular crushing patterns 100*a*; providing wavy second annular crushing patterns 200*a* spaced along the axial direction of the second crushing roller 200 so that second crushing cavities 200*b* are formed between the adjacent second annular crushing patterns 200*a*; and having crushing gaps 300 formed when the first annular crushing patterns 100*a* lodge in the second crushing cavities 200*b* and the second annular crushing patterns 200*a* lodge in the first crushing cavities 100*b*, and feeding cohesive attapulgite ores into the crushing gaps 300 that dynamically rise and fall when one of the first crushing roller 100 and the second crushing roller 200 rotates or when the first crushing roller 100 and the second crushing roller 200 rotate toward each other for anti-adhesion crushing.

Preferably, the crushing roller(s) may rotate continuously or in a stepped manner. Continuous crushing is conventional in the art. On the other hand, stepped crushing means that the crushing rollers rotate intermittently, and this provides a greater centrifugal acceleration that increases the centrifugal force acting on the clay pellets, so that the clay can come off the surfaces of the crushing rollers more easily.

Embodiment 4

The present embodiment discloses a crushing roller. Without causing conflict or contradiction, the entire and/or part of preferred modes of other embodiments may be incorporated into the present embodiment as supplements.

The crushing roller has wavy annular crushing patterns spaced in its axial direction, and crushing cavities are formed between adjacent annular crushing patterns.

When the crushing roller and a further crushing roller rotate toward each other or when either of which rotates, crushing gaps are formed when the annular crushing patterns lodge in crushing cavities of the further crushing roller and the wavy annular crushing patterns of the further crushing roller lodge in the crushing cavities of the crushing roller. When entering the crushing gaps that dynamically rise and fall, cohesive damp ores are crushed without adhering to the rollers.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not come off the concept of the present invention should be encompassed by the appended claims.

What is claimed is:

1. An anti-adhesion crushing tool for crushing cohesive damp ores into cohesive damp ore pellets, comprising:

a first crushing roller, wherein the first crushing roller comprises a first roller body, wherein the first roller body is a revolving member formed with an axial hole for receiving a first rotation shaft; and wherein the first crushing roller further comprises a plurality of crushing teeth, wherein the plurality of crushing teeth are arranged in a plurality of first annular crushing patterns running circumferentially around the first roller body, wherein each crushing tooth comprises a guiding-in slope, wherein the guiding-in slope has its angle θ change in a non-steep manner to connect to a top portion of the crushing tooth, wherein the top portion of the crushing tooth connects to a guiding-out slope, wherein the guiding-out slope has its angle β change in a non-steep manner, and the guiding-out slope connects to a valley portion, wherein the valley portion connects in a non-steep manner to a guiding-in slope of the adjacent crushing tooth so that a transitionally connecting portion that has at least two curvatures is formed between two adjacent crushing teeth; and a second crushing roller, wherein the second crushing roller comprises a second roller body, wherein the second roller body is a revolving member formed with an axial hole for receiving a second rotation shaft;

wherein the second crushing roller further comprises a plurality of crushing teeth, wherein the plurality of crushing teeth are arranged in a plurality of second annular crushing patterns running circumferentially around the second roller body, wherein each crushing tooth comprises a guiding-in slope, wherein the guiding-in slope has its angle θ change in a non-steep manner to connect to a top portion of the crushing tooth, wherein the top portion of the crushing tooth connects to a guiding-out slope, wherein the guiding-out slope has its angle β change in a non-steep manner, and the guiding-out slope connects to a valley portion, wherein the valley portion connects in a non-steep manner to a guiding-in slope of an adjacent crushing tooth, so that a transitionally connecting portion that has at least two curvatures is formed between two adjacent crushing teeth; and wherein the first annular crushing patterns are spaced in an axial direction of the first roller body, and wherein a first crushing cavity is formed in the space in between any two adjacent first annular crushing patterns of the first roller body, wherein said space is defined by the guiding-out slope, valley portion and transitionally connecting portion of said crushing tooth with the guiding-in slope of said adjacent tooth; and wherein the second annular crushing patterns are spaced in an axial direction of the second roller body, and wherein a second crushing cavity is formed in the space in between any two adjacent second annular crushing patterns of the second roller body, wherein said space is defined by the guiding-out slope, valley portion and transitionally connecting portion of said crushing tooth with the guiding-in slope of said adjacent tooth; and wherein the first crushing roller and the second crushing roller are such arranged that their axes are parallel to each other, and wherein when the first crushing roller and the second crushing roller rotate in relation to each other in a rotation direction (ω), so that in the rotation direction, the crushing teeth of the first annular crushing patterns of the first crushing roller lodge within the second crushing cavities of the second crushing roller to form a first match, and the crushing teeth of the second annular crushing patterns of the second crushing roller lodge within the first crushing cavities of the first crushing roller to form a second match; and wherein as the rotation of the crushing rollers occurs, a plurality of crushing gaps is formed in the axial direction between the first crushing roller and the second crushing roller, wherein each crushing gap is a radial interval formed by the first and second matches between the corresponding annular crushing patterns and crushing cavities of the first and second crushing rollers;

wherein a rate by which a guiding-in slope angle (θ) of the guiding-in slope changes with a guiding-in radial height of the guiding-in slope is smaller than a rate by which a guiding-out slope angle (β) of the guiding-out slope changes with a guiding-out radial height of the guiding-out slope, so that in the rotation direction of the first crushing roller and the second crushing roller, the curvature of the transitionally connecting portion at a guiding-in slope of a tooth is greater than the curvature of the transitionally connecting portion at the guiding-out slope of the adjacent tooth.

2. The crushing tool of claim 1, wherein during the rotation of the crushing rollers, the first and second annular crushing patterns are able to rotate with respect to the matched crushing cavities in a manner that the crushing gaps rise and fall.

3. The crushing tool of claim 2, wherein for each crushing tooth of the plurality of crushing teeth of the first crushing roller and the plurality of crushing teeth of the second crushing roller, the top portion has a flat-top shape.

4. The crushing tool of claim 3, wherein for each crushing tooth of the plurality of crushing teeth of the first crushing roller and the plurality of crushing teeth of the second crushing roller, during the rotation of the crushing rollers, two adjacent said crushing gaps in the axial direction are able to crush the cohesive damp ores into cohesive damp ore pellets in a manner that the crushing gaps rise and fall asynchronously.

5. The crushing tool of claim 4, wherein for each crushing tooth of the plurality of crushing teeth of the first crushing roller and the plurality of crushing teeth of the second crushing roller, a radial height ($R_h$) between the top portion and the valley portion of the crushing tooth of an annular crushing pattern is greater than a first radial width between the top portion and the corresponding crushing cavity, so that during the rotation of the first or second crushing roller, a second radial width of the crushing gap periodically changes based on the transitionally connecting portion that have at least two curvatures in a range between one time of the first radial width and more than two times of the first radial width.

6. The crushing tool of claim 5, wherein for each crushing tooth of the plurality of crushing teeth of the first crushing roller and the plurality of crushing teeth of the second crushing roller, the top portion has a radian smaller than a radian of the valley portion.

7. The crushing tool of claim 6, wherein for each crushing tooth of the plurality of crushing teeth of the first crushing roller and the plurality of crushing teeth of the second crushing roller, the first and second rollers are configured such that the cohesive ore pellets can come off the crushing cavities as the slope angle of the guiding-out slope gradually decreases in a manner that an adhesion force between the cohesive ore pellets and the crushing cavities is smaller than a centrifugal force applied thereto by the crushing roller.

8. The crushing tool of claim 7, wherein for each crushing tooth of the plurality of crushing teeth of the first crushing roller and the plurality of crushing teeth of the second crushing roller, in the rotation direction of the crushing roller, a front end of the valley portion that has a flat surface that extends to the guiding-out slope that extends to the top portion of the crushing tooth in a manner that the guiding-out slope angle of the guiding-out slope increases gradually, and a rear end of the valley portion extends to the guiding-in slope that extends to the top portion of said adjacent crushing tooth in a manner that the guiding-in slope angle increases gradually, so that the transitionally connecting portion that has at least two curvatures is formed between each two adjacent said crushing teeth.

9. The crushing roller of claim 6, wherein for each crushing tooth of the plurality of crushing teeth of the first crushing roller and the plurality of crushing teeth of the second crushing roller, when the annular crushing patterns engage with the corresponding crushing cavities, the cohesive ore pellets can come off the crushing cavities as the slope angle of the guiding-out slope gradually decreases in a manner that an adhesion force between the cohesive ore pellets and the crushing cavities is smaller than a centrifugal force applied thereto by the crushing rollers.

10. The crushing roller of claim 9, wherein for each crushing tooth of the plurality of crushing teeth of the first crushing roller and the plurality of crushing teeth of the second crushing roller, the top portion has grains, wherein a portion of each grain is parallel to the direction of linear velocity and adjacent grains are connected.

11. The crushing roller of claim 10, wherein for each crushing tooth of the plurality of crushing teeth of the first crushing roller and the plurality of crushing teeth of the second crushing roller, the radial height ($R_H$) between the top portion and the valley portion is greater than the minimum radial width between the top portion and the second crushing cavity, so that the cohesive attapulgite pellets can come off the valley portion under the action of the centrifugal force as the crushing gaps widen when the first crushing roller and the second crushing roller rotate toward each other.

12. The crushing roller of claim 11, wherein when the first crushing roller rotates with respect to the second crushing roller, the top portions and the valley portions work with the second crushing cavities to change the rising and falling profile of the crushing gaps.

13. An anti-adhesion crushing method for crushing attapulgite clay, comprising using the crushing tool of claim 1, wherein the crushing roller rotates in a continuous or stepped manner.

* * * * *